US005766056A

United States Patent [19]

Tsai

[11] Patent Number: 5,766,056

[45] Date of Patent: Jun. 16, 1998

[54] TRANSMISSION STRUCTURE OF TOY FIRE ENGINE

[76] Inventor: Wen Ho Tsai, 8Fl. No. 113, Yu Jen Rd., Taipei, Taiwan

[21] Appl. No.: 744,028

[22] Filed: Nov. 5, 1996

[51] Int. Cl.[6] ..... A63H 17/08

[52] U.S. Cl. ..... 446/288; 446/314; 446/432; 446/437; 446/465

[58] Field of Search ..... 446/288, 275, 446/276, 280, 285, 314, 432, 465, 470, 437

[56] References Cited

U.S. PATENT DOCUMENTS

| | | | |
|---|---|---|---|
| 474,486 | 5/1892 | Carpenter | 446/288 |
| 818,261 | 4/1906 | Kingsbury | 446/432 |
| 2,551,036 | 5/1951 | Mills | 446/432 |
| 5,139,456 | 8/1992 | Chuang | 446/231 |
| 5,542,872 | 8/1996 | Ho | 446/437 |
| 5,641,317 | 6/1997 | Huang | 446/232 |

FOREIGN PATENT DOCUMENTS

| | | | |
|---|---|---|---|
| 836458 | 4/1952 | Germany | 446/432 |

*Primary Examiner*—Robert A. Hafer
*Assistant Examiner*—Jeffrey D. Carlson
*Attorney, Agent, or Firm*—Pro-Techtor International

[57] ABSTRACT

A transmission structure of toy fire engine including a casing in which a power source is disposed and connected to a driving shaft for rotating two cams disposed in the casing and two cams disposed outside the casing. The outer cams serve to drive two lateral slide members to slide and push two decorative members pivotally disposed on two sides of the casing to pivot outward. One of the inner cams via a support rod abuts against a linkage set to drive a scaling ladder to pivot upward from the casing or downward to the casing. When the scaling ladder is pivoted to an upright position, a movable doll is driven to climb up along the scaling ladder. The other of the inner cams pushes a pushing slide member to depress a pushing shaft of a rotary power wheel set, making the rotary power wheel set descend and touch the ground for driving the toy fire engine to running.

9 Claims, 7 Drawing Sheets

TRANSMISSION STRUCTURE OF TOY FIRE ENGINE

BACKGROUND OF THE INVENTION

The present invention relates to a transmission structure of toy fire engine including a casing and a power source for driving a rotary power wheel set under the chassis. A cam pushes a pushing slide member to depress a pushing shaft of a rotary power wheel set, making the rotary power wheel set descend and touch the ground for driving the toy fire engine to running. Two front decorative members are disposed on two sides of the casing and can be pivoted outward. A scaling ladder is disposed on the top of the casing and can be pivoted upward. A movable doll is reciprocally slidably disposed on the scaling ladder in a stretched state.

Some conventional electric toy vehicles have simple functions such as automatically turning during running on the ground and emitting monotonous sound and light. Such operations are unchangeable and can hardly create versatile and attractive effect to satisfy curiosity of children. Some other electric toy vehicles are designed with various functions for enhancing attractivity. However, such toy vehicles have complicated transmission mechanism and thus are quite expensive.

Therefore, it is necessary to provide a toy vehicle which can create versatile operations while being manufactured at low cost.

SUMMARY OF THE INVENTION

It is a primary object of the present invention to provide a a transmission structure of toy fire engine including a casing in which a power source is disposed and connected to a driving shaft for rotating two cams disposed in the casing and two cams disposed outside the casing. The outer cams serve to drive two lateral slide members to slide and push two decorative members pivotally disposed on two sides of the casing to pivot outward. One of the inner cams via a support rod abuts against a linkage set to drive a scaling ladder to pivot upward from the casing or downward to the casing. When the scaling ladder is pivoted to an upright position, a movable doll is driven to climb up along the scaling ladder. The other of the inner cams pushes a pushing slide member to depress a pushing shaft of a rotary power wheel set, making the rotary power wheel set descend and touch the ground for driving the toy fire engine to running. According to the above arrangement, the toy fire engine can perform versatile funny and live operation for achieving great entertaining effect.

The present invention can be best understood through the following description and accompanying drawings, wherein:

DETAILED DESCRIPTION OF THE PREFERRED EMBODIMENT

Figure 1:
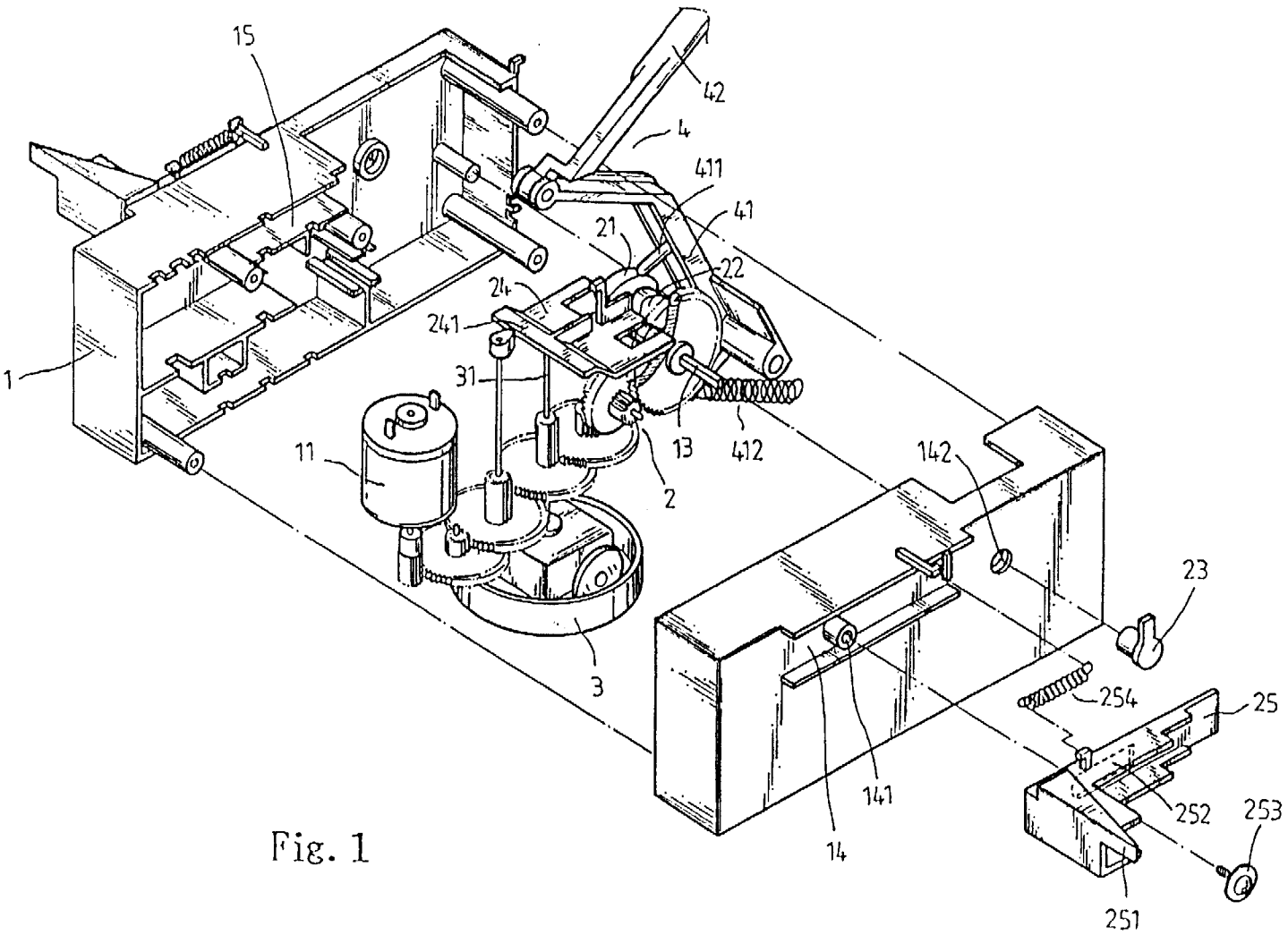
FIG. 1 is a perspective exploded view of the present invention.
Figure 2A:
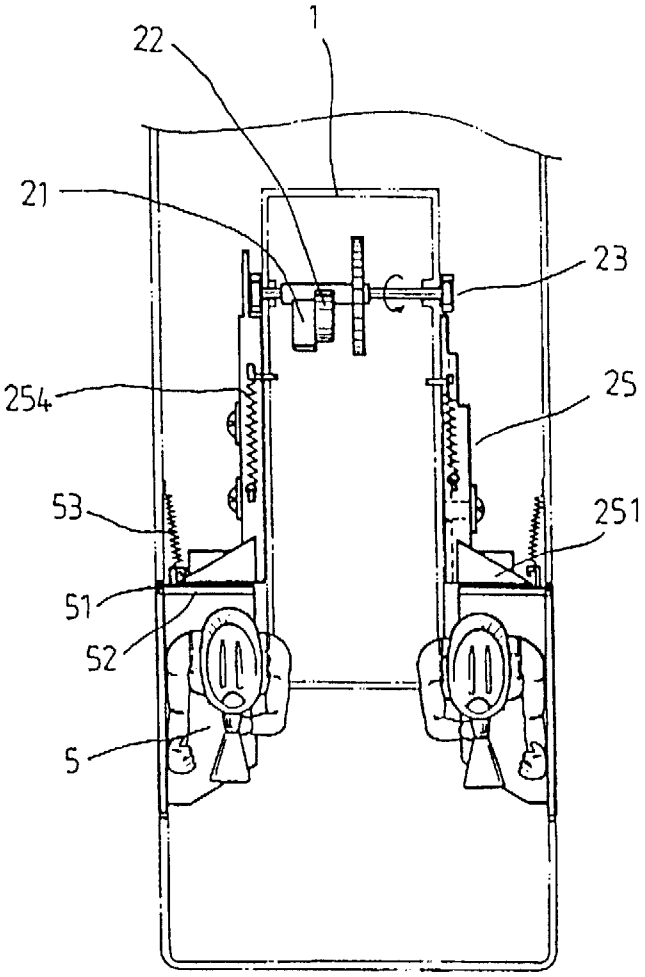
FIG. 2A shows that the front decorative members of the present invention are not pivoted outward.
Figure 2B:
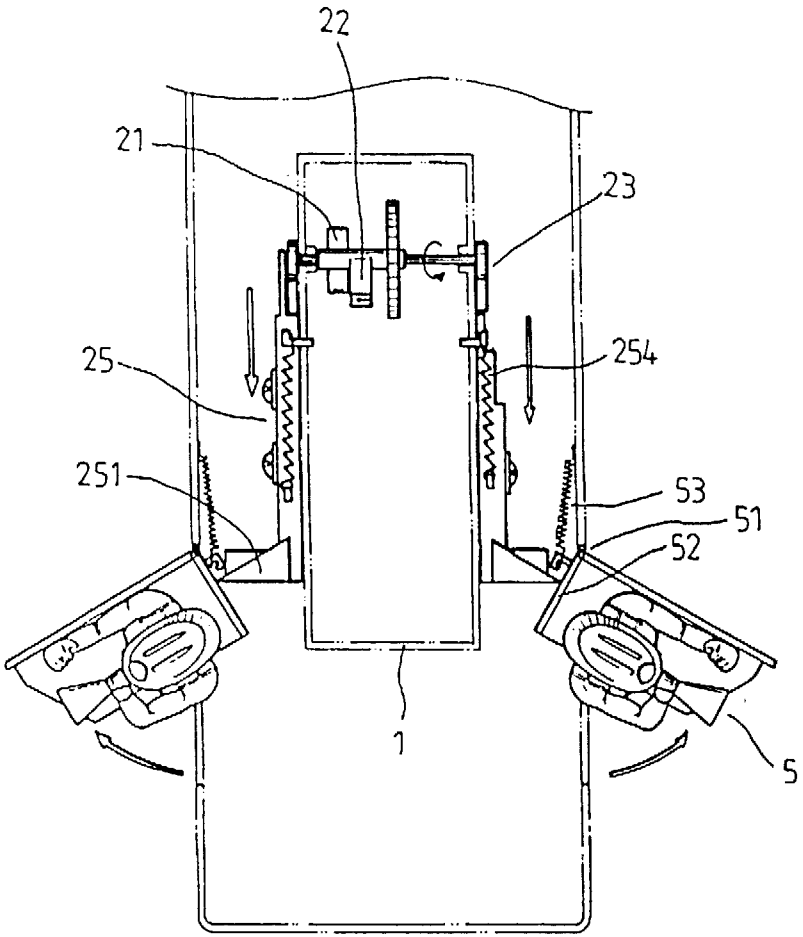
FIG. 2B shows that the front decorative members of the present invention are pivoted outward.
Figure 3A:
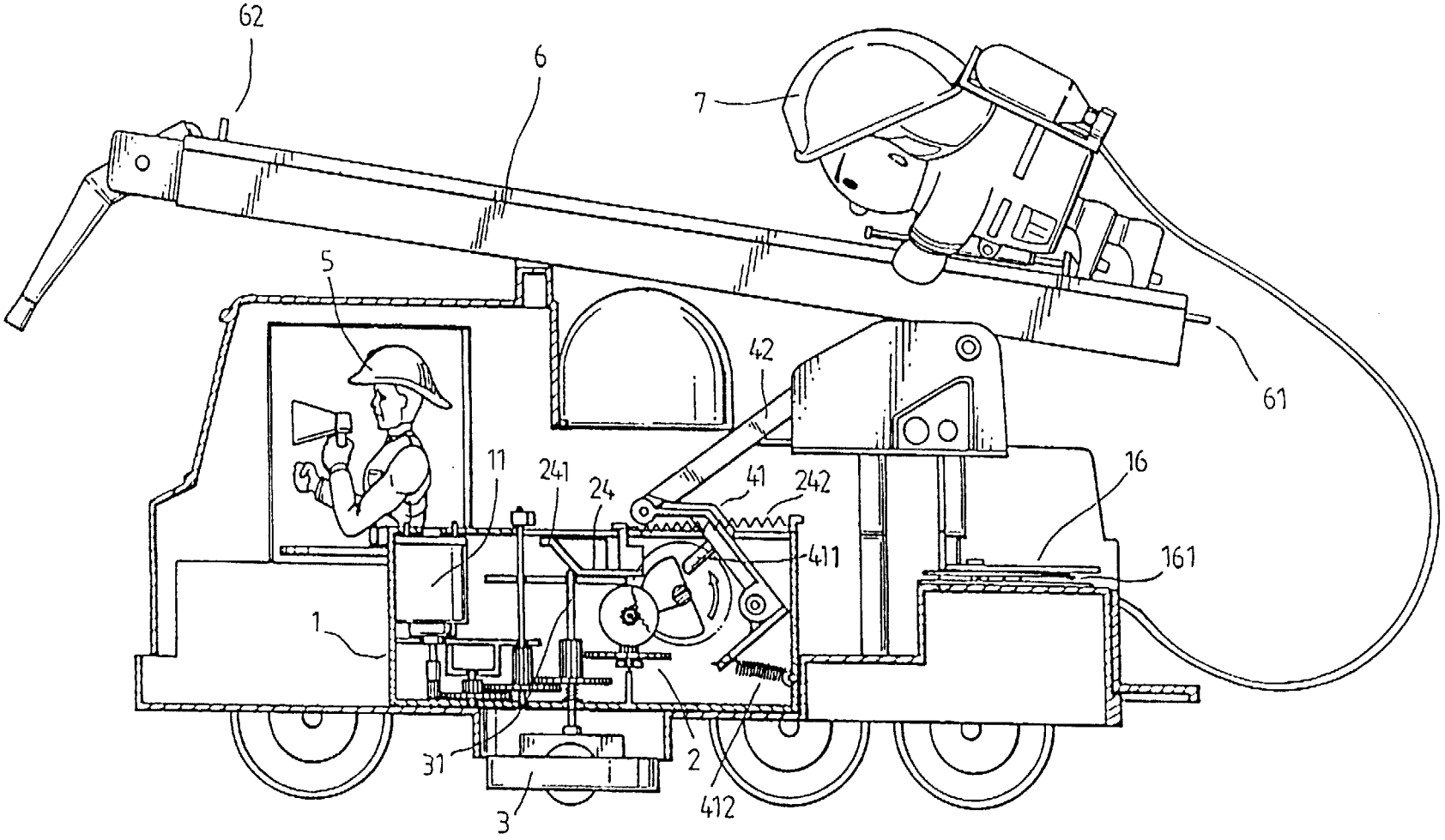
FIG. 3A shows that the rotary power wheel set of the present invention is lowered.
Figure 3B:
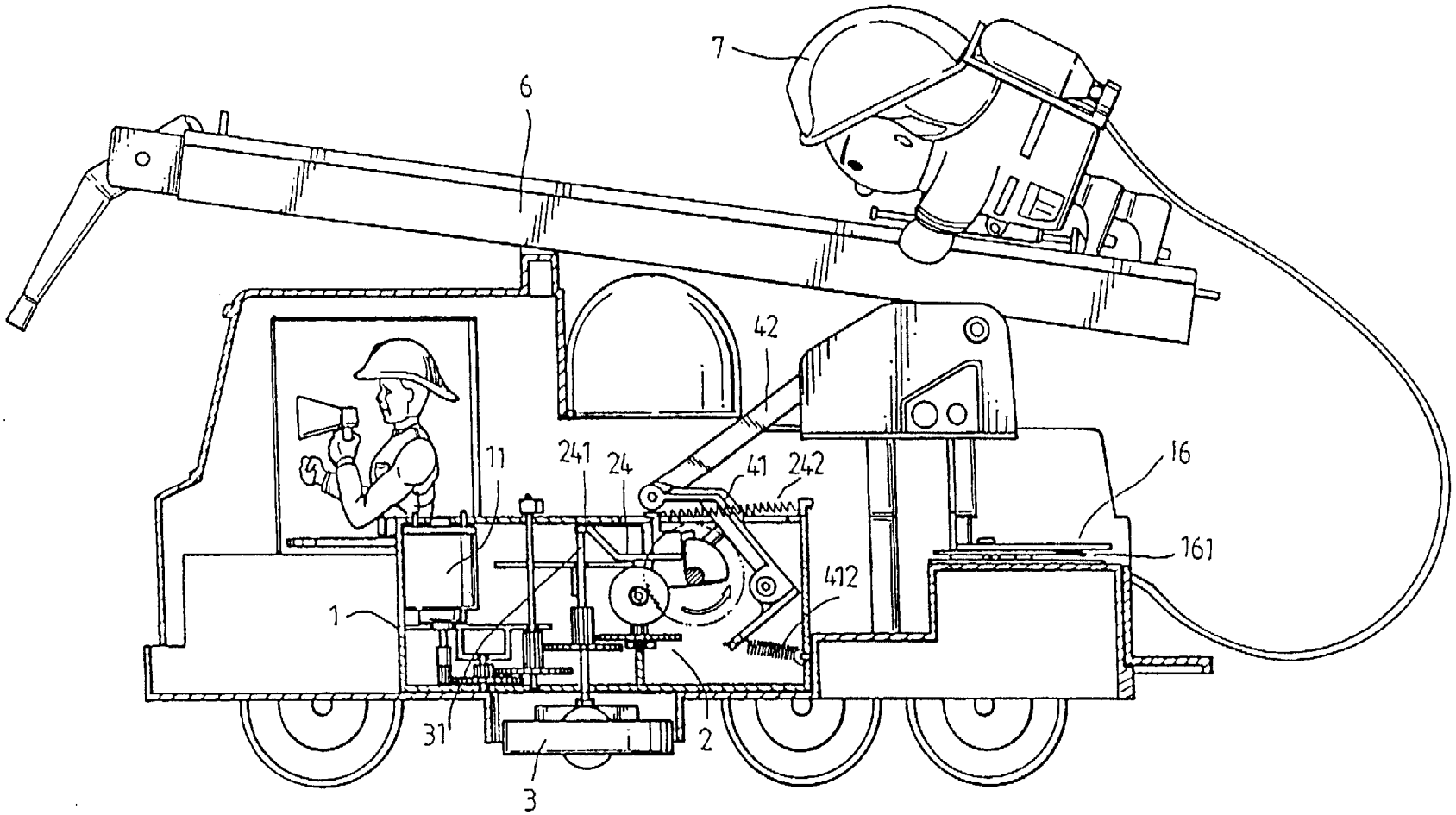
FIG. 3B shows that the rotary power wheel set of the present invention is lifted.
Figure 4A:
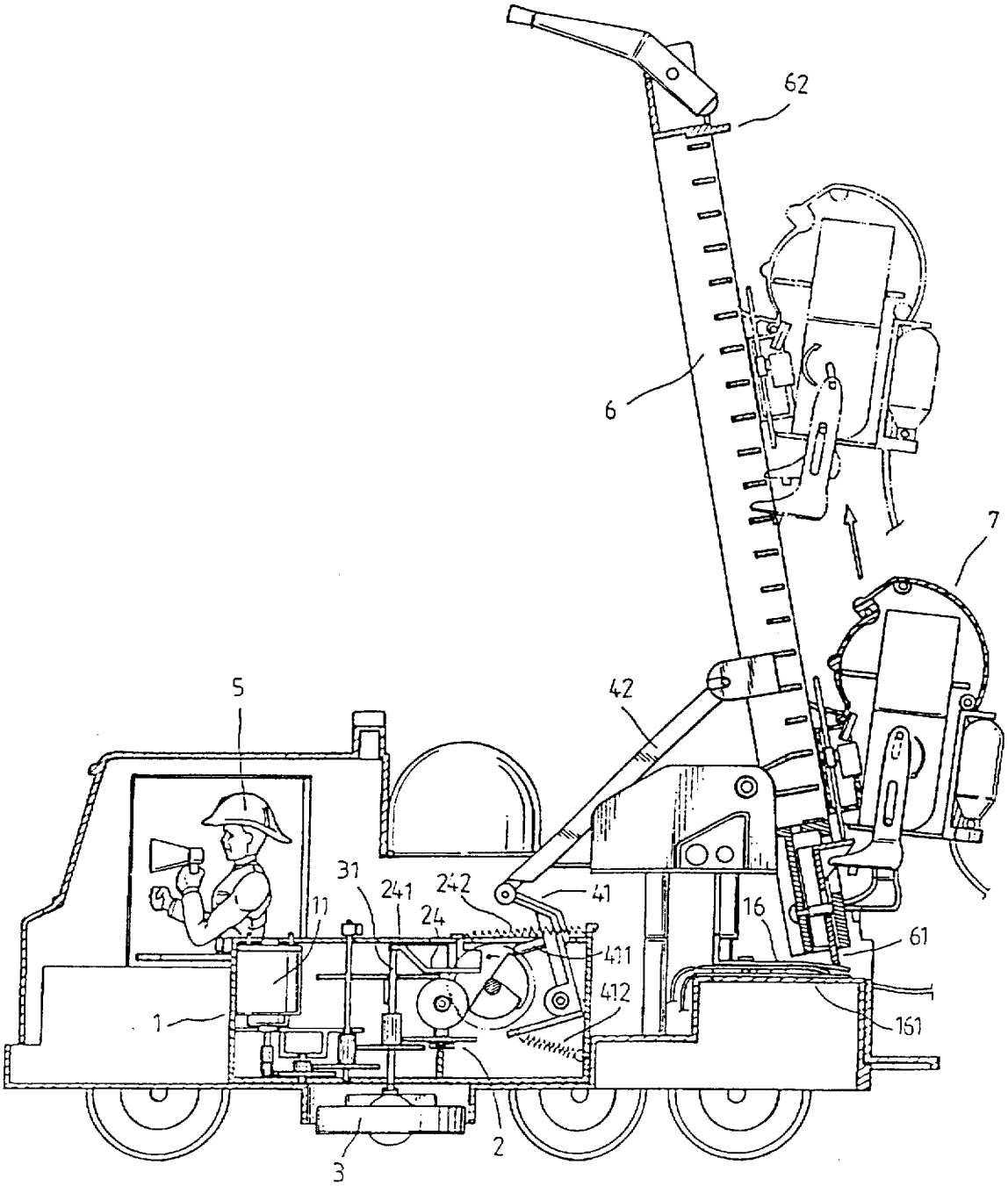
FIG. 4A shows that the scaling ladder of the present invention is pivoted upward and the movable decorative member climbs up along the scaling ladder.
Figure 4B:
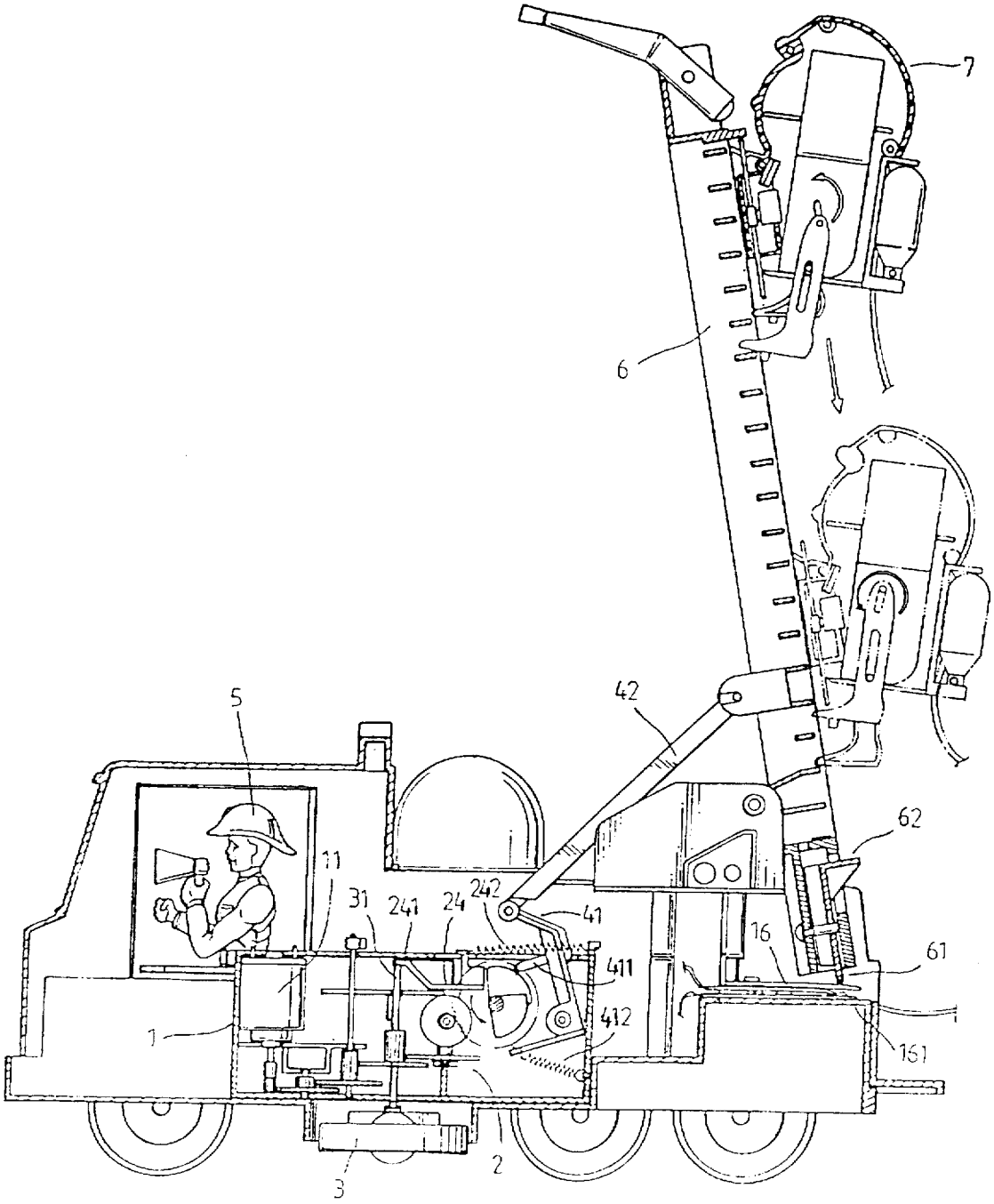
FIG. 4B shows that the scaling ladder of the present invention is pivoted upward and the movable decorative member climbs down along the scaling ladder.
Figure 5:
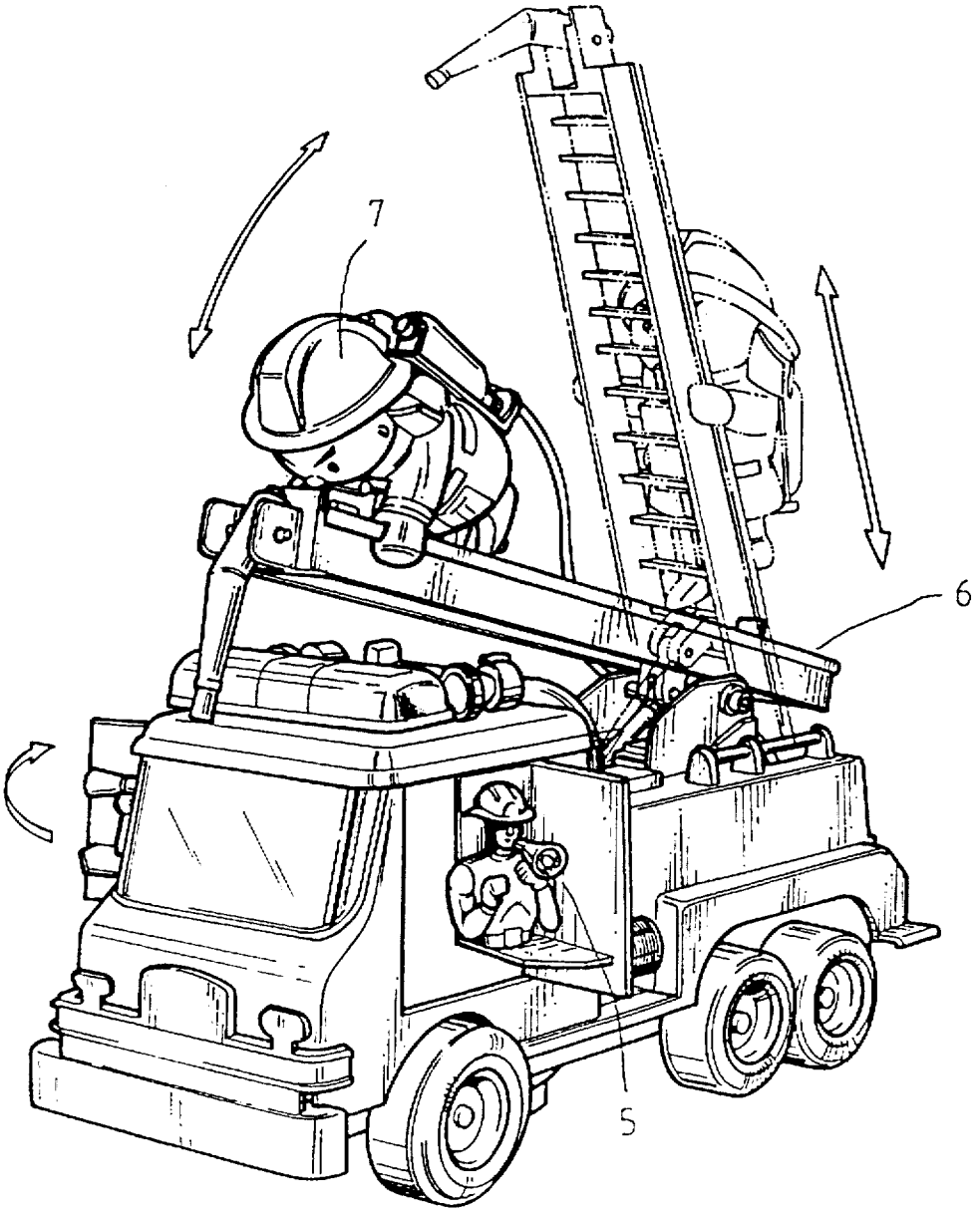
FIG. 5 is a perspective view showing the complete operation of the present invention.

Please refer to FIG. 1. The present invention mainly includes a casing 1, a driving mechanism 2, a rotary power wheel set 3, a linkage set 4, a front decorative member 5, a scaling ladder 6 and a movable decorative member 7. A power source 11 is disposed in the casing 1 and connected to a gear set 12. The rear end of the gear set 12 is disposed with a driving shaft 13 for outputting the power of the power source. A pushing guide channel 15 is disposed on inner upper side of the casing 1 and two lateral guide channels 14 are respectively disposed on two outer lateral sides of the casing 1. A locating thread hole 141 is formed at a middle section inside each lateral guide channel 14. A through hole 142 is formed beside one end of the lateral guide channel 14. A resilient depression plate 16 is disposed outside the casing 1. Two separate conductive plates 161 are sandwiched between the depression plate 16 and the casing 1. The driving mechanism 2 is connected to the driving shaft 13 via a first cam 21, a second cam 22 and two lateral cams 23 for obtaining the power. The first and second cams 21, 22 are rotatably fitted around a middle section of the driving shaft 13 by reverse phase, while the two lateral cams 23 extend from outer sides of the casing 1 into the through holes 142 to be secured at two ends of the driving shaft 13. The second cam 22 abuts against one end of a pushing slide member 24 inserted in the pushing guide channel 15 of the casing 1. A middle section of the pushing slide member 24 is hooked and retained on the casing 1 by a restoring spring 242. The other end of the pushing slide member 24 is disposed with an upward inclined slope pushing face 241. Each lateral cam 23 abuts against one end of a lateral slide member 25 on outer lateral side. A middle section of the lateral slide member 25 is disposed with a locating slot 252 for a locating bolt 253 to pass therethrough and screw into the locating thread hole 141 of the casing 1, whereby the lateral slide member 25 is limitedly slidable within the lateral guide channel 14. The other end of the lateral slide member 25 is disposed with an outward extending pushing projection 251 and a middle section of the lateral slide member 25 is hooked and retained on the casing 1 by a restoring spring 254. A pushing shaft 31 is disposed at the top section of the rotary power wheel set 3 and extends into the pushing guide channel 15 of the casing 1. The pushing slide member 24 is pushed by the second cam 22 as well as pulled by the restoring spring 242 so as to reciprocally slide within the pushing guide channel 15. When the pushing slide member 24 slides toward the front side of the casing 1 to a position above the pushing shaft 31 of the rotary power wheel set 3, by means of the guiding of the slope pushing face 241, the pushing slide member 24 can smoothly depress the pushing shaft 31. When depressed, the pushing shaft 31 drives the rotary power wheel set 3 to descend and touch the ground. After the second cam 22 continuously rotates to separate from the pushing slide member 24, the same is pulled by the restoring spring 242 to slide rearward. At this time, the pushing shaft 31 drives the rotary power wheel set 3 to move upward and separate from the ground and restore to its home position. The linkage set 4 includes a first linking lever 41 and a second linking lever 42. A middle section of the first linking lever 41 is disposed with a suspending support rod 411, whereby a restoring spring 412 pulls the support rod 411 to abut against the first cam 21. The front decorative member 5 is pivotally disposed on each outer side of one end of the casing 1 via a pivot shaft 51. A stopper board 52 is disposed on back side of the decorative member. A middle section of the stopper board 52 is hooked and retained in the casing 1 by a restoring spring 53. Each end of the scaling ladder 6 is disposed with a projecting pushing board 62 and is pivotally connected with the casing 1 at one end. The second linking lever 42 abuts against a middle section of the scaling ladder 6. One end of the scaling ladder 6 is additionally disposed with a projection 61, whereby when the scaling ladder 6 is upward pivoted to an upper dead point, the projection 61 pushes and depresses the resilient depression plate 16 to compress the conductive plates 161 so as to close the circuit. The movable decorative member 7 is disposed on the scaling ladder 6 and can slide therealong. A turning switch 71 is disposed on the movable decorative member 7, whereby when the movable decorative member 7 slides to the front or rear dead point of the scaling ladder 6, the turning switch 71 touches the pushing board 62 to change the direction of movement ( reverse sliding ).

The present invention is operated in a manner as follows:

The driving shaft 13 of the power source 11 drives the first cam 21, second cam 22 and two lateral cams 23 to rotate. The second cam 22 pushes the pushing slide member 24 to slide forward within the pushing guide channel 15 of the casing 1. By means of the guiding of the slope pushing face 241, the pushing slide member 24 depresses the pushing shaft 31 to make the rotary power wheel set 3 descend and touch the ground. At this time, the rotary power wheel set 3 operates to drive the casing 1 to start running on the ground. After the second cam 22 continuously rotates to separate from the pushing slide member 24, the pushing slide member 24 is pulled by the restoring spring 242 to slide rearward. At this time, the pushing shaft 31 drives the rotary power wheel set 3 to move upward from the ground and restore to its home position and the casing 1 stops running. At this time, the first cam 21 pushes the support rod 411, making the first linking lever 41 via the second linking lever 42 push the scaling ladder 6 to pivot upward. When the scaling ladder 6 is pivoted upward to the upper dead point, the projection 61 just abuts against and depresses the resilient depression plate 16, making the conductive plates 161 contact with each other to close the circuit, whereby the movable decorative member 7 starts sliding along the scaling ladder 6. When the turning switch 71 of the movable decorative member 7 touches the projecting pushing boards 62 at two ends of the scaling ladder 6, the movable decorative member 7 changes its moving direction at the dead points of two ends of the scaling ladder 6. When the first cam 21 rotates to a position separate from the support rod 411, the first linking lever 41 is pulled by the restoring spring 412 to via the second linking lever 42 drive the scaling ladder 6 back to its home position. At the same time, the projection 61 separates from the resilient depression plate 16 to space the conductive plates 161 from each other so as to cut off the power for the movable decorative member 7 which is then stopped.

It should be noted that many modifications of the above preferred embodiment can be made without departing from the spirit of the present invention. The scope of the present invention should be defined only by the appended claims.

What is claimed is:

1. A transmission structure of toy fire engine, comprising:

a casing, a power source being disposed in the casing and connected to a driving shaft via a gear set;

a driving mechanism including a first cam and a second cams fitted around a middle section of the driving shaft, two lateral cams fitted around two ends of the driving shaft, a slidable pushing slide member and two lateral slide members, the lateral cams abutting against the lateral slide members, while one of the first and second cams abutting against the pushing slide member;

a rotary power wheel set having a pushing shaft upward projecting from top side thereof into a sliding path of the pushing slide member, a gear being disposed around the pushing shaft for engaging with the gear set;

a linkage set including a first and a second linking levers, a middle section of the first linking lever being disposed with a support rod, whereby the other of the first and second cams abuts against and pushes the support rod to pivot upward;

multiple front decorative members pivotally disposed on two sides of the casing, whereby the lateral slide members push the front decorative members to pivot outward;

a scaling ladder, one end of the scaling ladder being pivotally disposed on the casing, a middle section of the scaling ladder being pushed by the second linking lever of the linkage set to pivot the other end of the scaling ladder upward; and a movable decorative member reciprocally slidably disposed on the scaling ladder, whereby the four cams respectively push the pushing slide member, lateral slide members and first linking lever and the pushing slide member depresses the pushing shaft, making the rotary power wheel set descend and touch the ground for running, the lateral slide members pushing back sides of the front decorative members, making the same pivot outward about pivot shafts, the first linking lever pushing the scaling ladder to move upward, whereby after the scaling ladder ascends to an upper dead point, the movable decorative member starts to reciprocally slide along the scaling ladder.

2. A transmission structure as claimed in claim 1, wherein a resilient depression plate is disposed on outer side of the casing, two separate conductive plates being sandwiched between the depression plate and the casing, whereby when one end of the scaling ladder is pivoted upward, the other end thereof is moved downward to depress the resilient depression plate, making the conductive plates contact with each other to close a circuit for powering on the movable decorative member.

3. A transmission structure as claimed in claim 1, wherein the casing is disposed with an inner pushing guide channel in which the pushing slide member is slidably fitted.

4. A transmission structure as claimed in claim 1, wherein two lateral sides of the casing are disposed with opposite lateral guide channels in which the lateral slide members are slidably fitted.

5. A transmission structure as claimed in claim 4, wherein each lateral slide member is formed with a locating slot for a locating bolt to pass therethrough to screw into a middle section of the lateral guide channel, whereby the lateral slide member is limited to only slide within the lateral guide channel.

6. A transmission structure as claimed in claim 1, wherein one end of the pushing slide member is formed with a slope pushing face for guiding the pushing slide member to smoothly depress the pushing shaft of the rotary power wheel set.

7. A transmission structure as claimed in claim 1, wherein the pushing slide member has a projecting post inserted in a middle section of the first linking lever for driving the same to swing.

8. A transmission structure as claimed in claim 1, wherein the pushing slide member, lateral slide members and first linking lever are respectively connected to the casing via resilient members, whereby when the cams stop pushing these members, the same are restored by the resilient force of the resilient members to their home positions.

9. A transmission structure as claimed in claim 1, wherein two projecting pushing boards are disposed at two ends of the scaling ladder and a turning switch is disposed on the movable decorative member, whereby when the movable decorative member slides to two ends of the scaling ladder, the turning switch touches the projecting pushing boards to make the movable decorative member reversely move.

* * * * *